US009173259B1

(12) United States Patent
Peng

(10) Patent No.: US 9,173,259 B1
(45) Date of Patent: Oct. 27, 2015

(54) LIGHT EMITTING DIODE DRIVING SYSTEM AND LIGHT EMITTING DIODE LAMP

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 14/473,655

(22) Filed: Aug. 29, 2014

(51) Int. Cl.
*H05B 37/02* (2006.01)
*H05B 33/08* (2006.01)

(52) U.S. Cl.
CPC ..... *H05B 33/0809* (2013.01); *H05B 33/0842* (2013.01)

(58) Field of Classification Search
CPC .. H05B 37/02; H05B 37/029; H05B 37/0254; H05B 33/0803; H05B 33/0842; H05B 33/0845; H05B 33/0857
USPC ..... 315/200 R, 209 R, 291–297, 307, 308, 315/312
See application file for complete search history.

(56) References Cited

U.S. PATENT DOCUMENTS 6,369,517 B2 * 4/2002 Song ..... H05B 37/0209 315/159
8,410,717 B2 * 4/2013 Shteynberg ..... H05B 33/0812 315/185 R
8,742,693 B2 * 6/2014 Ikeda ..... G05F 1/44 315/254

* cited by examiner

*Primary Examiner* — Jimmy Vu
(74) *Attorney, Agent, or Firm* — Muncy, Geissler, Olds & Lowe, P.C.

(57) ABSTRACT

A light emitting diode driving system includes a plurality of light emitting diode driving apparatuses and a transmission line. The transmission line is electrically connected to the light emitting diode driving apparatuses. The light emitting diode driving apparatus includes a voltage regulator, a synchronous signal generation circuit and a synchronous control logic circuit. The voltage regulator sends a first voltage to the synchronous signal generation circuit. The synchronous signal generation circuit generates a second voltage after the synchronous signal generation circuit receives the first voltage. The synchronous signal generation circuit subtracts the second voltage from the first voltage to obtain a synchronous signal. The synchronous signal generation circuit sends the synchronous signal to the synchronous control logic circuit. The light emitting diode driving apparatuses drive the light emitting diodes synchronously according to the synchronous signals.

6 Claims, 4 Drawing Sheets

LIGHT EMITTING DIODE DRIVING SYSTEM AND LIGHT EMITTING DIODE LAMP

BACKGROUND OF THE INVENTION

1. Field of the Invention

The present invention relates to a light emitting diode driving system and a light emitting diode lamp, and especially relates to an improved light emitting diode driving system and an improved light emitting diode lamp.

2. Description of the Related Art

Nowadays, the connection types of the light emitting diode lamp string modules are separated into two types: the serial-type connection and the parallel-type connection. The light emitting diode lamp string modules are widely used for external walls of the building, decoration of trees, signboards and scenery designing.

In the related art serial-type light emitting diode lamp string modules, a plurality of light emitting diode lamp string modules are commonly connected in series. Also, the amount of the light emitting diode lamp string modules is determined according to the volume of the decorated objects. In addition, all of the light emitting diode lamp string modules are controlled by the same controller which initially controls the first light emitting diode lamp string module.

Although the light emitting diode lamp string modules are easily connected together, the remaining light emitting diode lamp string modules behind the abnormal light emitting diode lamp string module cannot be lighted even only one of the light emitting diode lamp string modules is abnormal. That is because the control signal cannot be sent to drive all of the remaining light emitting diode lamp string modules.

The parallel-type light emitting diode lamp string modules are connected to the controller in parallel. Accordingly, each one of the light emitting diode lamp string modules is controlled by the controller through a control line and an address line, respectively. For example, ten control lines and ten address lines need to be used when ten light emitting diode lamp string modules are employed to be connected in parallel.

The remaining light emitting diode lamp string modules can still be normally controlled when one of the light emitting diode lamp string modules is abnormal. However, the amount of the control lines and the address lines increase proportionally. Therefore, complexity and the costs of the equipment also increase when the amount of the light emitting diode lamp string modules increases.

No matter the connection type of the light emitting diode lamp string modules is the serial-type or the parallel-type, many power transmission lines and signal transmission lines need to be used to control the colors and intensities of the light emitting diode lamp string modules. Accordingly, cost down can be achieved only if the amount of the power transmission lines or the signal transmission lines can be reduced.

SUMMARY OF THE INVENTION

In order to solve the above-mentioned problems, an object of the present invention is to provide a light emitting diode driving system.

In order to solve the above-mentioned problems, another object of the present invention is to provide a light emitting diode lamp.

In order to achieve the object of the present invention mentioned above, the light emitting diode driving system is applied to an alternating current power supply apparatus, a rectifying filtering circuit and a plurality of light emitting diodes. The alternating current power supply apparatus is electrically connected to the rectifying filtering circuit. The light emitting diode driving system is electrically connected to the rectifying filtering circuit and the light emitting diodes. The light emitting diode driving system comprises a plurality of light emitting diode driving apparatuses and a transmission line. The light emitting diode driving apparatuses are electrically connected to the rectifying filtering circuit and the light emitting diodes. The light emitting diode driving apparatuses are connected to each other in series. The transmission line is electrically connected to the rectifying filtering circuit and the light emitting diode driving apparatuses. The light emitting diode driving apparatus comprises a power positive contact, a voltage regulator, a power negative contact, a synchronous signal generation circuit and a synchronous control logic circuit. The power positive contact is electrically connected to the rectifying filtering circuit and the transmission line. The voltage regulator is electrically connected to the power positive contact. The power negative contact is electrically connected to the voltage regulator. The synchronous signal generation circuit is electrically connected to the voltage regulator. The synchronous control logic circuit is electrically connected to the voltage regulator and the synchronous signal generation circuit. The alternating current power supply apparatus sends an alternating current power to the rectifying filtering circuit. The rectifying filtering circuit rectifies and filters the alternating current power to obtain a direct current power. The rectifying filtering circuit sends the direct current power to the voltage regulator. The voltage regulator generates a first voltage after the voltage regulator receives the direct current power. The voltage regulator sends the direct current power to a next light emitting diode driving apparatus after the voltage regulator generates the first voltage. The voltage regulator sends the first voltage to the synchronous signal generation circuit after the voltage regulator generates the first voltage. The synchronous signal generation circuit generates a second voltage after the synchronous signal generation circuit receives the first voltage. The synchronous signal generation circuit subtracts the second voltage from the first voltage to obtain a synchronous signal. The synchronous signal generation circuit sends the synchronous signal to the synchronous control logic circuit. The light emitting diode driving apparatuses drive the light emitting diodes synchronously according to the synchronous signals.

In order to achieve another object of the present invention mentioned above, the light emitting diode lamp is applied to an alternating current power supply apparatus and a rectifying filtering circuit. The alternating current power supply apparatus is electrically connected to the rectifying filtering circuit. The light emitting diode lamp comprises: a light emitting diode driving apparatus electrically connected to the rectifying filtering circuit. The light emitting diode driving apparatus comprises: a power positive contact electrically connected to the rectifying filtering circuit; a voltage regulator electrically connected to the power positive contact; a power negative contact electrically connected to the voltage regulator; a synchronous signal generation circuit electrically connected to the voltage regulator; a synchronous control logic circuit electrically connected to the voltage regulator and the synchronous signal generation circuit; and at least a light emitting diode electrically connected to the synchronous control logic circuit. A plurality of the light emitting diode driving apparatuses are connected to each other in series The alternating current power supply apparatus sends an alternating current power to the rectifying filtering circuit The rectifying filtering circuit rectifies and filters the alternating current power to obtain a direct current power The rectifying filtering circuit sends the direct current power to the voltage regulator.

The voltage regulator generates a first voltage after the voltage regulator receives the direct current power The voltage regulator sends the direct current power to a next light emitting diode driving apparatus after the voltage regulator generates the first voltage The voltage regulator sends the first voltage to the synchronous signal generation circuit after the voltage regulator generates the first voltage. The synchronous signal generation circuit generates a second voltage after the synchronous signal generation circuit receives the first voltage The synchronous signal generation circuit subtracts the second voltage from the first voltage to obtain a synchronous signal. The synchronous signal generation circuit sends the synchronous signal to the synchronous control logic circuit. The light emitting diode driving apparatuses drive the light emitting diodes synchronously according to the synchronous signals.

The efficiency of the present invention is to reduce the transmission lines of the light emitting diode driving system. Therefore, the cost of the light emitting diode driving system is reduced.

DETAILED DESCRIPTION OF THE INVENTION

Figure 1:
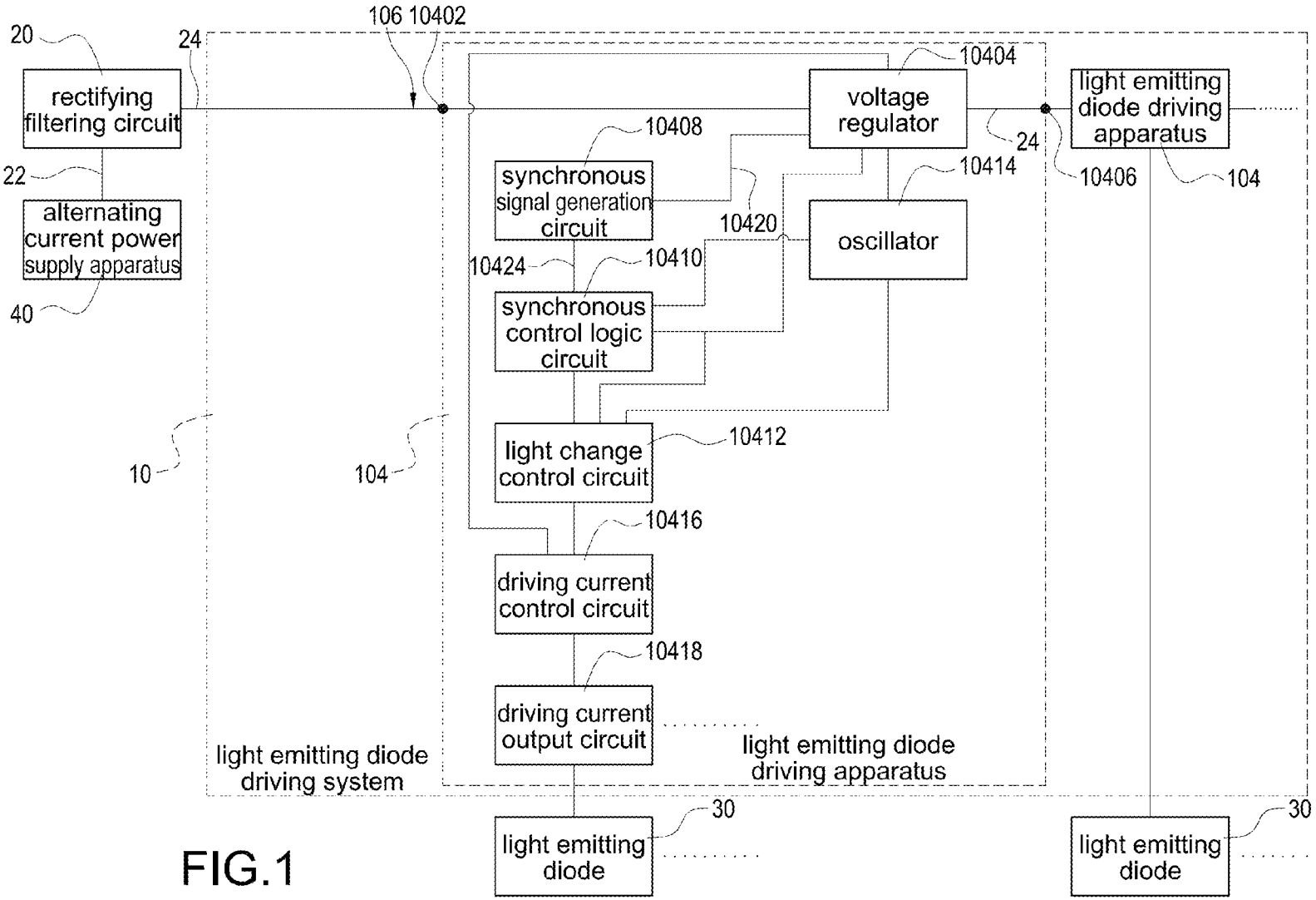
FIG. 1 shows a block diagram of the light emitting diode driving system of the present invention.

FIG. 1 shows a block diagram of the light emitting diode driving system of the present invention. A light emitting diode driving system 10 is applied to an alternating current power supply apparatus 40, a rectifying filtering circuit 20 and a plurality of light emitting diodes 30. The alternating current power supply apparatus 40 is electrically connected to the rectifying filtering circuit 20. The light emitting diode driving system 10 is electrically connected to the rectifying filtering circuit 20 and the light emitting diodes 30.

The light emitting diode driving system 10 comprises a plurality of light emitting diode driving apparatuses 104 and a transmission line 106. The light emitting diode driving apparatuses 104 are electrically connected to the rectifying filtering circuit 20 and the light emitting diodes 30. The light emitting diode driving apparatuses 104 are connected to each other in series. The transmission line 106 is electrically connected to the rectifying filtering circuit 20 and the light emitting diode driving apparatuses 104.

The light emitting diode driving apparatus 104 comprises a power positive contact 10402, a voltage regulator 10404, a power negative contact 10406, a synchronous signal generation circuit 10408, a synchronous control logic circuit 10410, a light change control circuit 10412, an oscillator 10414, a driving current control circuit 10416 and a plurality of driving current output circuits 10418.

The power positive contact 10402 is electrically connected to the rectifying filtering circuit 20 and the transmission line 106. The voltage regulator 10404 is electrically connected to the power positive contact 10402. The power negative contact 10406 is electrically connected to the voltage regulator 10404. The synchronous signal generation circuit 10408 is electrically connected to the voltage regulator 10404. The synchronous control logic circuit 10410 is electrically connected to the voltage regulator 10404 and the synchronous signal generation circuit 10408. The light change control circuit 10412 is electrically connected to the voltage regulator 10404 and the synchronous control logic circuit 10410.

The oscillator 10414 is electrically connected to the voltage regulator 10404, the synchronous control logic circuit 10410 and the light change control circuit 10412. The driving current control circuit 10416 is electrically connected to the voltage regulator 10404 and the light change control circuit 10412. The driving current output circuits 10418 are electrically connected to the driving current control circuit 10416 and the light emitting diodes 30.

The alternating current power supply apparatus 40 sends an alternating current power 22 to the rectifying filtering circuit 20. The rectifying filtering circuit 20 rectifies and filters the alternating current power 22 to obtain a direct current power 24. The rectifying filtering circuit 20 sends the direct current power 24 to the voltage regulator 10404.

The voltage regulator 10404 generates a first voltage 10420 after the voltage regulator 10404 receives the direct current power 24. The voltage regulator 10404 sends the direct current power 24 to a next light emitting diode driving apparatus 104 after the voltage regulator 10404 generates the first voltage 10420. The voltage regulator 10404 sends the first voltage 10420 to the synchronous signal generation circuit 10408 after the voltage regulator 10404 generates the first voltage 10420.

The synchronous signal generation circuit 10408 generates a second voltage 10422 after the synchronous signal generation circuit 10408 receives the first voltage 10420. The synchronous signal generation circuit 10408 subtracts the second voltage 10422 from the first voltage 10420 to obtain a synchronous signal 10424. The synchronous signal generation circuit 10408 sends the synchronous signal 10424 to the synchronous control logic circuit 10410. The light emitting diode driving apparatuses 104 drive the light emitting diodes 30 synchronously according to the synchronous signals 10424.

The transmission line 16 carries the direct current power 24. The voltage regulator 10404 generates the first voltage 10420 according to the direct current power 24. The synchronous signal generation circuit 10408 generates the second voltage 10422 according to the first voltage 10420. The synchronous signal generation circuit 10408 generates the synchronous signal 10424 according to the first voltage 10420 and the second voltage 10422.

Therefore, the light emitting diode driving system 10 only uses the transmission line 106 to carry the direct current power 24, and then the synchronous signal 10424 is generated. The transmission lines of the light emitting diode driving system are reduced. Therefore, the cost of the light emitting diode driving system is reduced.

Moreover, the synchronous control logic circuit 10410 is configured to control and process circuit logic and then inform the light change control circuit 10412. The light change control circuit 10412 is configured to determine colors and intensities of the light emitting diodes 30 and then inform the driving current control circuit 10416. The driving current control circuit 10416 of each of the light emitting diode driving apparatuses 104 is configured to control the driving current output circuit 10418 to drive the light emitting diodes synchronously. Therefore, all of the light emitting diodes are driven synchronously.

Moreover, the light emitting diode driving system 10 can save more transmission lines if the rectifying filtering circuit 20 is a half bridge structure (in comparison with the rectifying filtering circuit 20 being a full bridge structure). The voltage regulator 10404 is, for example but not limited to, a Zener diode. The light emitting diode 30 can be a chip and packed with the light emitting diode driving apparatus 104 as a light emitting diode lamp.

Figure 2:
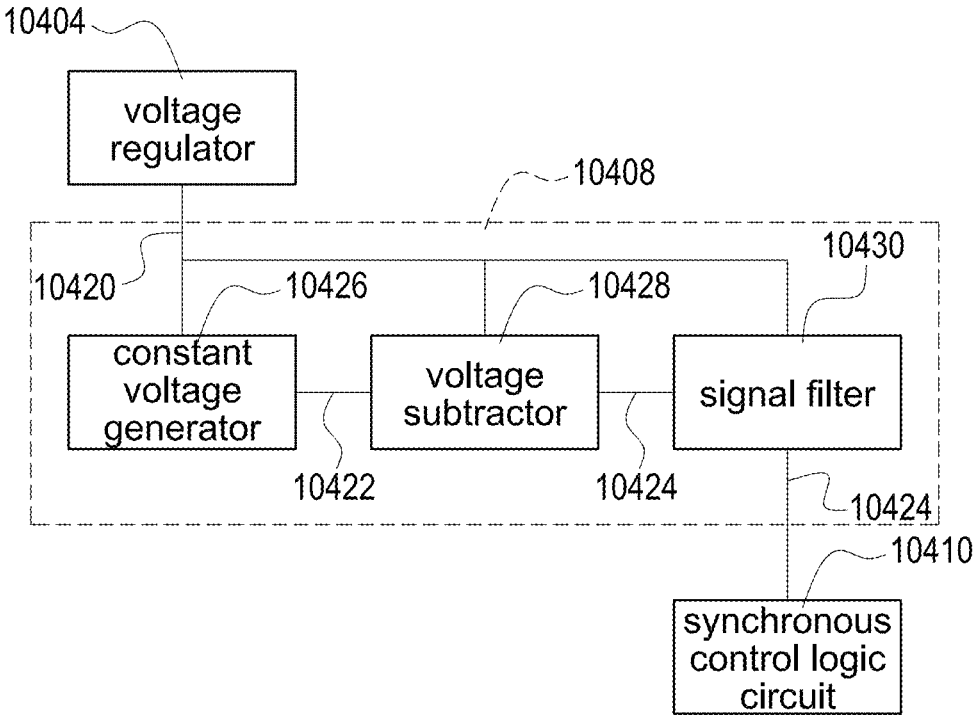
FIG. 2 shows a block diagram of the synchronous signal generation circuit of the present invention.

FIG. 2 shows a block diagram of the synchronous signal generation circuit of the present invention. The synchronous signal generation circuit 10408 comprises a constant voltage generator 10426, a voltage subtractor 10428 and a signal filter 10430. The constant voltage generator 10426 is electrically connected to the voltage regulator 10404. The voltage subtractor 10428 is electrically connected to the voltage regulator 10404 and the constant voltage generator 10426. The signal filter 10430 is electrically connected to the voltage regulator 10404, the constant voltage generator 10426, the voltage subtractor 10428 and the synchronous control logic circuit 10410.

The voltage regulator 10404 sends the first voltage 10420 to the constant voltage generator 10426, the voltage subtractor 10428 and the signal filter 10430. The constant voltage generator 10426 generates the second voltage 10422 after the constant voltage generator 10426 receives the first voltage 10420. The constant voltage generator 10426 sends the second voltage 10422 to the voltage subtractor 10428.

The voltage subtractor 10428 subtracts the second voltage 10422 from the first voltage 10420 to obtain the synchronous signal 10424 after the voltage subtractor 10428 receives the first voltage 10420 and the second voltage 10422. The voltage subtractor 10428 sends the synchronous signal 10424 to the signal filter 10430. The signal filter 10430 filters a noise of the synchronous signal 10424, and then the signal filter 10430 sends the synchronous signal 10424 to the synchronous control logic circuit 10410. The light emitting diode driving apparatuses 104 drive the light emitting diodes 30 synchronously according to the synchronous signals 10424.

Figure 3:
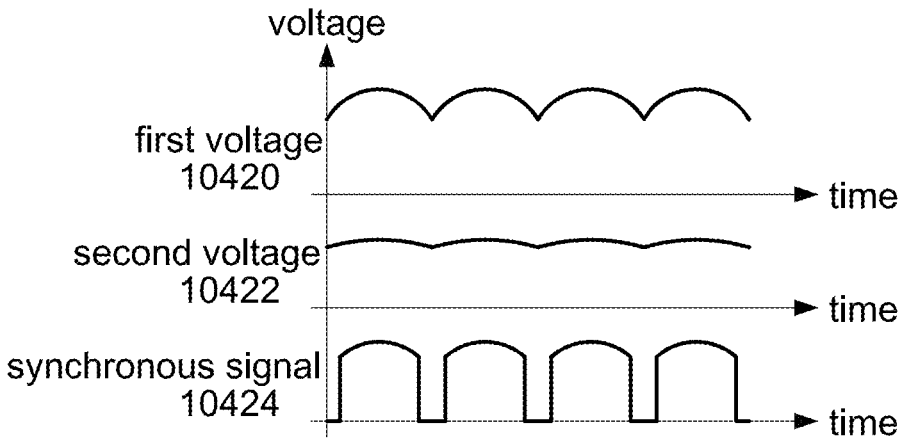
FIG. 3 shows a waveform diagram of an embodiment of the present invention (if the rectifying filtering circuit is a full bridge structure).
Figure 4:
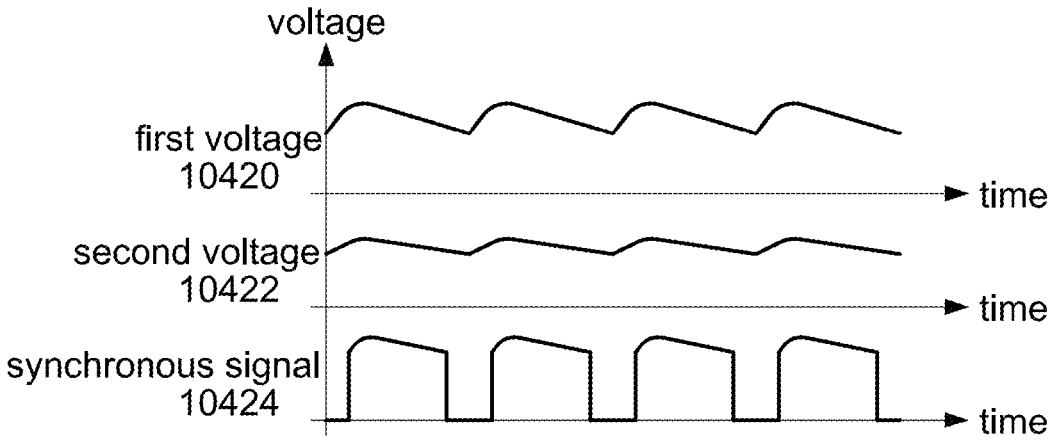
FIG. 4 shows a waveform diagram of another embodiment of the present invention (if the rectifying filtering circuit is a half bridge structure).

FIG. 3 shows a waveform diagram of an embodiment of the present invention (if the rectifying filtering circuit is a full bridge structure). FIG. 4 shows a waveform diagram of another embodiment of the present invention (if the rectifying filtering circuit is a half bridge structure).

The voltage regulator 10404 generates the first voltage 10420 after the voltage regulator 10404 receives the direct current power 24. The constant voltage generator 10426 generates the second voltage 10422 after the constant voltage generator 10426 receives the first voltage 10420. The voltage subtractor 10428 subtracts the second voltage 10422 from the first voltage 10420 to obtain the synchronous signal 10424 after the voltage subtractor 10428 receives the first voltage 10420 and the second voltage 10422.

Figure 5:
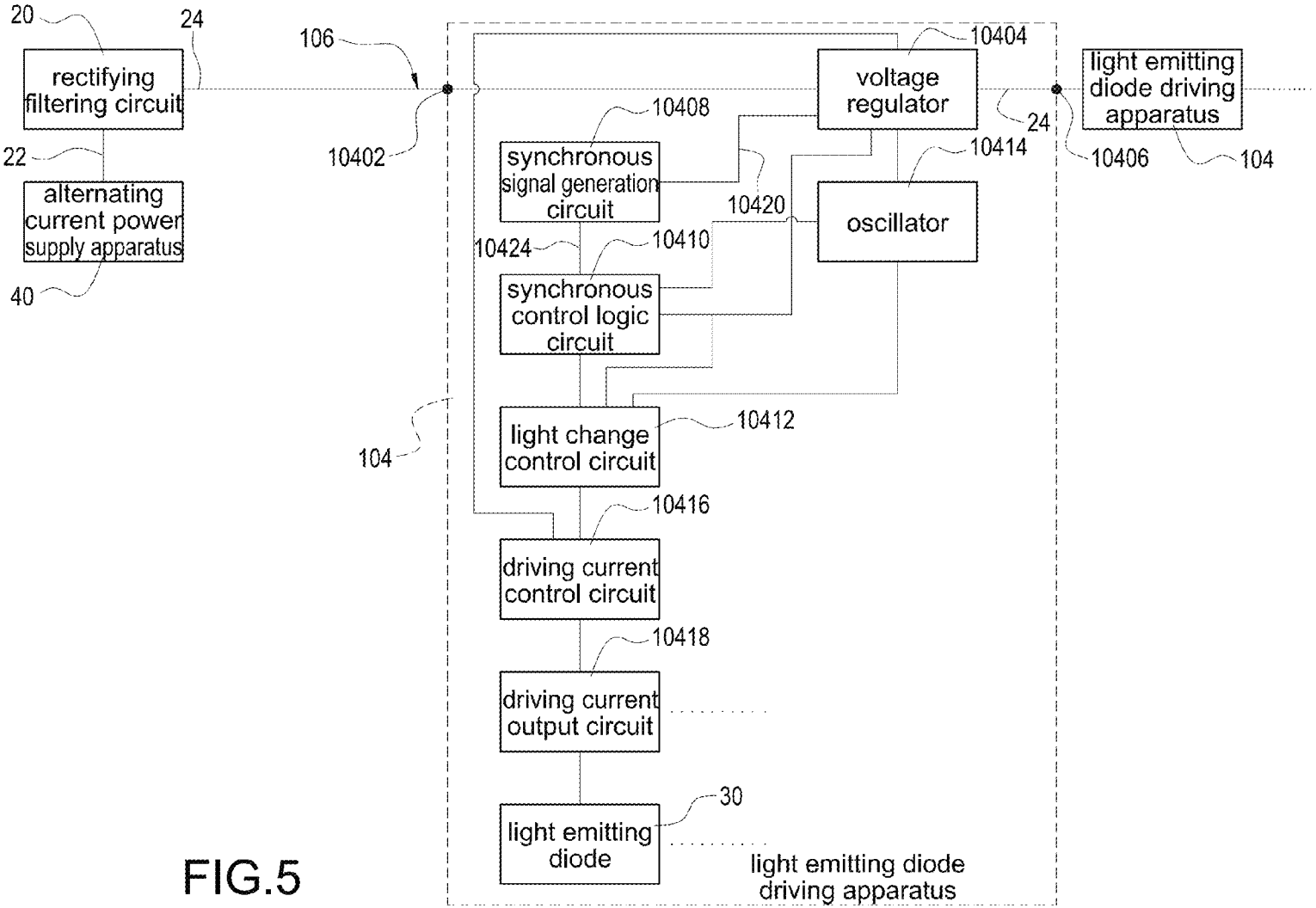
FIG. 5 shows a block diagram of the light emitting diode lamp (driving apparatus) of the present invention.

FIG. 5 shows a block diagram of the light emitting diode lamp (driving apparatus) of the present invention. The description for the elements shown in FIG. 5, which are similar to those shown in FIG. 1 to FIG. 4, is not repeated here for brevity. Moreover, the light emitting diode driving apparatus 104 (lamp) further comprises at least a light emitting diode 30 electrically connected to the synchronous control logic circuit 10410.

The advantage of the present invention is to reduce the transmission lines of the light emitting diode driving system (lamp). Therefore, the cost of the light emitting diode driving system (lamp is reduced.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode driving system applied to an alternating current power supply apparatus, a rectifying filtering circuit and a plurality of light emitting diodes, the alternating current power supply apparatus electrically connected to the rectifying filtering circuit, the light emitting diode driving system electrically connected to the rectifying filtering circuit and the light emitting diodes, the light emitting diode driving system comprising:

a plurality of light emitting diode driving apparatuses electrically connected to the rectifying filtering circuit and the light emitting diodes, the light emitting diode driving apparatuses connected to each other in series; and a transmission line electrically connected to the rectifying filtering circuit and the light emitting diode driving apparatuses, wherein the light emitting diode driving apparatus comprises:

a power positive contact electrically connected to the rectifying filtering circuit and the transmission line;

a voltage regulator electrically connected to the power positive contact;

a power negative contact electrically connected to the voltage regulator;

a synchronous signal generation circuit electrically connected to the voltage regulator; and a synchronous control logic circuit electrically connected to the voltage regulator and the synchronous signal generation circuit, wherein the alternating current power supply apparatus sends an alternating current power to the rectifying filtering circuit; the rectifying filtering circuit rectifies and filters the alternating current power to obtain a direct current power; the rectifying filtering circuit sends the direct current power to the voltage regulator;

wherein the voltage regulator generates a first voltage after the voltage regulator receives the direct current power; the voltage regulator sends the direct current power to a next light emitting diode driving apparatus after the voltage regulator generates the first voltage; the voltage regulator sends the first voltage to the synchronous signal generation circuit after the voltage regulator generates the first voltage;

wherein the synchronous signal generation circuit generates a second voltage after the synchronous signal generation circuit receives the first voltage; the synchronous signal generation circuit subtracts the second voltage from the first voltage to obtain a synchronous signal; the synchronous signal generation circuit sends the synchronous signal to the synchronous control logic circuit; the light emitting diode driving apparatuses drive the light emitting diodes synchronously according to the synchronous signals.

2. The light emitting diode driving system in claim 1, wherein the synchronous signal generation circuit comprises:

a constant voltage generator electrically connected to the voltage regulator;

a voltage subtractor electrically connected to the voltage regulator and the constant voltage generator; and a signal filter electrically connected to the voltage regulator, the constant voltage generator, the voltage subtractor and the synchronous control logic circuit.

3. The light emitting diode driving system in claim 2, wherein the light emitting diode driving apparatus further comprising:

a light change control circuit electrically connected to the voltage regulator and the synchronous control logic circuit;

an oscillator electrically connected to the voltage regulator, the synchronous control logic circuit and the light change control circuit;

a driving current control circuit electrically connected to the voltage regulator and the light change control circuit; and a plurality of driving current output circuits electrically connected to the driving current control circuit and the light emitting diodes.

4. A light emitting diode lamp applied to an alternating current power supply apparatus and a rectifying filtering circuit, the alternating current power supply apparatus electrically connected to the rectifying filtering circuit, the light emitting diode lamp comprising:

a light emitting diode driving apparatus electrically connected to the rectifying filtering circuit, the light emitting diode driving apparatus comprising:

a power positive contact electrically connected to the rectifying filtering circuit;

a voltage regulator electrically connected to the power positive contact;

a power negative contact electrically connected to the voltage regulator;

a synchronous signal generation circuit electrically connected to the voltage regulator;

a synchronous control logic circuit electrically connected to the voltage regulator and the synchronous signal generation circuit; and at least a light emitting diode electrically connected to the synchronous control logic circuit, wherein a plurality of the light emitting diode driving apparatuses are connected to each other in series; the alternating current power supply apparatus sends an alternating current power to the rectifying filtering circuit; the rectifying filtering circuit rectifies and filters the alternating current power to obtain a direct current power; the rectifying filtering circuit sends the direct current power to the voltage regulator;

wherein the voltage regulator generates a first voltage after the voltage regulator receives the direct current power; the voltage regulator sends the direct current power to a next light emitting diode driving apparatus after the voltage regulator generates the first voltage; the voltage regulator sends the first voltage to the synchronous signal generation circuit after the voltage regulator generates the first voltage;

wherein the synchronous signal generation circuit generates a second voltage after the synchronous signal generation circuit receives the first voltage; the synchronous signal generation circuit subtracts the second voltage from the first voltage to obtain a synchronous signal; the synchronous signal generation circuit sends the synchronous signal to the synchronous control logic circuit; the light emitting diode driving apparatuses drive the light emitting diodes synchronously according to the synchronous signals.

5. The light emitting diode lamp in claim 4, wherein the synchronous signal generation circuit comprises:

a constant voltage generator electrically connected to the voltage regulator;

a voltage subtractor electrically connected to the voltage regulator and the constant voltage generator; and a signal filter electrically connected to the voltage regulator, the constant voltage generator, the voltage subtractor and the synchronous control logic circuit.

6. The light emitting diode lamp in claim 5, wherein the light emitting diode driving apparatus further comprises:

a light change control circuit electrically connected to the voltage regulator and the synchronous control logic circuit;

an oscillator electrically connected to the voltage regulator, the synchronous control logic circuit and the light change control circuit;

a driving current control circuit electrically connected to the voltage regulator and the light change control circuit; and a plurality of driving current output circuits electrically connected to the driving current control circuit and the light emitting diodes.

* * * * *